US005491843A

United States Patent [19]

Naughton

[11] Patent Number: 5,491,843

[45] Date of Patent: Feb. 20, 1996

[54] EXERCISE SHROUD

[76] Inventor: Daniel P. Naughton, 3140 Midway Dr., #A-212, San Diego, Calif. 92110

[21] Appl. No.: 342,627

[22] Filed: Nov. 21, 1994

[51] Int. Cl.[6] ..... A41D 13/04

[52] U.S. Cl. ..... 2/48

[58] Field of Search ..... 2/46–52, 69, 231, 2/207, 219, 220, 221, 235, 209.13

[56] References Cited

U.S. PATENT DOCUMENTS

| | | | |
|---|---|---|---|
| D. 231,810 | 6/1974 | Daley | 2/48 X |
| 540,756 | 6/1895 | Odell | 2/49.2 |
| 1,131,532 | 3/1915 | McClure | 2/221 X |
| 1,135,833 | 4/1915 | Morse | 2/51 X |
| 1,196,800 | 9/1916 | Miller | 2/221 |
| 1,493,815 | 5/1924 | Hogan | 2/48 |
| 2,129,486 | 4/1938 | Berman | 2/51 |
| 2,244,656 | 6/1941 | Asch | 2/49.5 |
| 2,756,430 | 7/1956 | West | 2/48 |
| 4,009,494 | 3/1977 | Nusbaum | 2/48 X |
| 4,833,731 | 5/1989 | Foxman | 2/69 X |
| 5,016,291 | 5/1991 | Capper | 2/221 X |
| 5,046,195 | 9/1991 | Koritan | 2/209.13 X |
| 5,107,545 | 4/1992 | Potter | 2/51 X |

*Primary Examiner*—C. D. Crowder
*Assistant Examiner*—Shirra L. Jenkins
*Attorney, Agent, or Firm*—Frank G. Morkunas

[57] ABSTRACT

The invention is an exercise shroud for use by exercisers to conceal perspiration stains on their exercise garments. It is formed of a waistband and at least two layers of material attached to the back portion of the waistband. The layers extend downward from the waistband and are configured and sized such to cover the backside of an exerciser. The inner and outer layers of material are separable from each other and are detachable from the waistband. Hook-and-loop fasteners are the preferred fastener for connecting the inner and outer layers together and for attaching them to the waistband. The inner layer is made of a moisture-repellent material. Being moisture-repellent, this layer prevents the perspiration from penetrating to the outer visible layer. When worn by an exerciser, the shroud conceals perspiration stains which have penetrated the exerciser's exercise garment and have become outwardly visible.

19 Claims, 1 Drawing Sheet

EXERCISE SHROUD

BACKGROUND OF THE INVENTION

This invention relates to an exercise shroud. More specifically to a shroud to conceal the perspiration stains of an exerciser on the exerciser's exercise garment. A portion of the shroud is made of a moisture-repellent material which keeps the perspiration from penetrating therethrough past the protective cover of the shroud. This invention satisfies a need expressed by indoor exercisers, primarily aerobic exercisers.

The dawn of health consciousness has brought a wave of physical-fitness related products to aid the health-conscious individual. Exercise devices, exercise clothing, and exercise accessories have saturated the market and have been a boon to all who are interested in exercise to maintain good health. Many exercisers have found aerobics to suit their circulatory, respiratory, muscular, and general health needs. A variety of exercise garments are used for aerobics ranging from home-created cut-off pants and jersey, to custom-made and fitted tights.

Heavy aerobic exercise, however, leads to heavy perspiration. When this occurs, the perspiration secreted by the body is absorbed by the exerciser's garment and as the garment becomes saturated, the perspiration shows through and is exposed to fellow exercisers and casual observers. These perspiration stains, particularly on the backside of the exercise garment, whether the perspiration is heavy or light, can be embarrassing to many exercisers and a need exists to conceal, or cover, the offending stain. Many exercisers have worn towels, or shirts with arms wrapped around the waist, to conceal the embarrassing stain so that they may continue to exercise without embarrassment. Using these items is cumbersome, unsightly, non-functional (since these items also absorb the perspiration and, when saturated, expose a stain therethrough nonetheless), and can interfere with the exercise routine. To date, no product has provided a suitable protective cover, aesthetic in appearance, which does not impede or interfere with the exercise routine until now.

Prior inventions providing protection to an exerciser have focused generally on outdoor activity. These inventions consist of the following:

U.S. Pat. No. 3,708,799 (Smithdeal '799) discloses a seat protection garment of single, substantially rectangular, layer of plastic or rubber material worn as an outer garment from the backside waist of a user to protect the user from outside moisture penetrating inward. It has defined waist and thigh sections wrapping around both sections when worn. It is particularly suited to a skier to protect the skier from outside moisture when the skier is seated on a ski-lift chair. A drawstring inside the waist and thigh section secures the garment to the skier's waist and thighs. When not used to protect against moisture, the thigh sections are untied and the garment is rolled up to the waist and secured thereto by a strap which is attached to the backside of the garment. The shielding portion of the garment cannot be removed from the drawstring without first untying the drawstring and sliding the drawstring out of the garment.

U.S. Pat. No. 4,689,829 (Kaplan '829) discloses a similar seat covering device for skiers. It consists of a single or multi-layered rectangular garment worn on the outside from the backside waistline of a skier. Its outer layer is of a moisture-repellant material to protect the skier from outside moisture penetrating inward. The inner layer(s) can be of absorbent material(s). A waistband is fixedly secured to the cover. The cover hangs loosely downward from the skier's backside when in use as a protective device and rolls up to the waistband, secured thereto by loops on the waistband when the skier is skiing.

U.S. Pat. No. 4,894,869 (Boll '869) discloses a protective under garment having multiple layers, the outer layer of which is of a moisture-repellent material. The inner layer(s) can be of absorbent material(s). The garment has a backside, no front-side, elastic waist and thigh straps to directly and snugly cling to and cover the buttocks, whereby the outer layer of moisture-repellent material protects the user from outside moisture penetrating inward.

U.S. Pat. No. 5,012,543 (Lewis '543) discloses an athletic towel for joggers which is single layered, substantially rectangular, and preferably and entirely constructed of terry cloth. The towel has a waistband, integral to the towel, with end straps fixedly attached to the waistband. The waistband wraps around the jogger's waist thereby securing it to the jogger. The towel is used by the jogger to wipe perspiration from hands and face while jogging.

While these inventions are unique, they are primarily suited to their respective purposes. The athletic towel in particular is suited to wipe and absorb perspiration not to provide a protective barrier from it. None of these inventions, therefore, is suited to the needs of an indoor user, particularly with regard to aerobic exercises, and none provides the features necessary for such a user. The present invention satisfies that need.

SUMMARY OF THE INVENTION

The present invention satisfies the need of the exerciser by concealing perspiration stains on the backside of an exerciser, providing a shroud comprising at least two separably connected layers as a perspiration barrier, the inner-most layer of which is of a moisture-repellant material, to prevent the perspiration from migrating past the protective shroud and exposing the stain to a casual observer or other aerobic exercisers. The outer-most layer can be decorative. The outer layers can consist of either moisture-repellant or absorbent material. Since the inner and outer layers can be separable this novel feature permits the user to easily change the appearance of the shroud. The individual layers can be connected at their respective top and bottom sections, or only at their respective top sections, by appropriate fasteners suitable for the purpose intended, including, but not limited to, hook-and-loop fasteners, hook-and-eye fasteners, and male-and-female snap fasteners. The fasteners for this purpose are on the inner surface of the successive outer layers with cooperating fasteners on the outer surface of the successive adjacent inner layers. The layers also can be permanently connected to one another. The shroud is removably attachable to the back portion of a separate waistband by appropriate fasteners suitable for the purpose intended, including, but not limited to, hook-and-loop fasteners, hook-and-eye fasteners, and male-and-female snap fasteners. These fasteners are positioned substantially on the back portion of the waistband and on the top section of the inner surface of the inner-most layer. The inner and outer layers can be easily separated from each other and can be easily removed from the waistband as user needs dictate (e.g., for aesthetic reasons or for functional reasons like wiping perspiration from the user or for wiping gym equipment before and after use).

The structure and versatility of the present invention far exceeds that of the prior art in providing the user with a moisture barrier to keep perspiration from penetrating outward, in providing an aesthetically pleasing exercise shroud, in providing the user with virtual unrestricted freedom of movement, in providing the user with the ability to easily detach the layers completely from the waistband as well as providing the user with the flexibility of changing the entire appearance of the shroud by merely separating the outermost layer from an adjacent inner layer and by replacing the outer-most layer with a different type, color, or shape outer-most layer, and by providing the user with a handy wiping material as necessary to wipe perspiration from the user and to clean exercise equipment. Many geometric shapes can be used for the layers including, but not limited to, rectangular, square, semi-circular, semi-oblong, and triangular.

An object of this invention is to provide an exerciser with a shroud to conceal perspiration stains on the user's exercise garment.

A second object of this invention is to provide an exerciser with a moisture-proof barrier between the exerciser's exercise garment and the outer-most decorative layer of the shroud.

Another object of this invention is to provide an exerciser with protection from visible perspiration stains and simultaneously to provide freedom of movement while exercising.

Another object of this invention is to provide an exerciser with the ability to easily, conveniently, and completely remove the entire shroud as exercise needs dictate and, with equal ease and convenience, to reapply the shroud.

Another object of this invention is to make it extremely easy to launder the shroud in that, since the shroud can be completely taken apart (i.e., layers removed from waistband and layers separated from each other), only those portions of the shroud which actually require laundering need be laundered.

Another object of this invention is to provide an exercise accessory which conceals excess weight of the exerciser.

Another object of this invention is to provide an exerciser with a shroud having protective layers which are aesthetically pleasing and easily separable and interchangeable with one another.

Another object of this invention is to provide an exerciser with a shroud having more than one layer the ability to easily, conveniently, and completely remove the outer-most layer, leaving the inner-most layer attached to the waistband, and to apply another outer-most layer without exposing perspiration stains of the exerciser's exercise garment.

Other objects and features of the invention will become apparent as the drawings which follow are understood by reading the corresponding description thereof.

BRIEF DESCRIPTION OF THE DRAWING FIGURES

DESCRIPTION OF THE PREFERRED EMBODIMENTS

Figure 1:
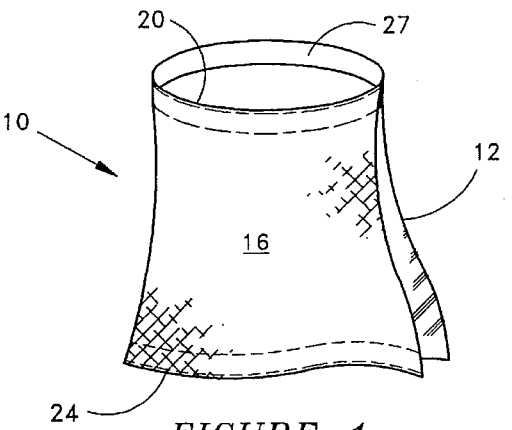
FIG. 1 is a perspective rear elevation view of the shroud fully assembled.

FIG. 1 reveals an assembled two-layered shroud 10 as seen from the rear. It shows the shroud 10 with an inner layer 12 connected to an outer layer 16 at the top 20 of the shroud 10 and the inner layer 12 attached to the back of the waistband 27. The inner layer 12 is formed of a moisture-repellant material and the outer layer 16 is formed of either a moisture-repellant or an absorbent material. In this figure, the inner layer 12 is only attached to the outer layer 16 at the top 20 of the shroud 10. The shroud 10 is completely disassemblable by a user while being worn. That is, outer layer 16 is detachable from inner layer 12, and inner layer 12 is detachable from the waistband 27.

Figure 2:
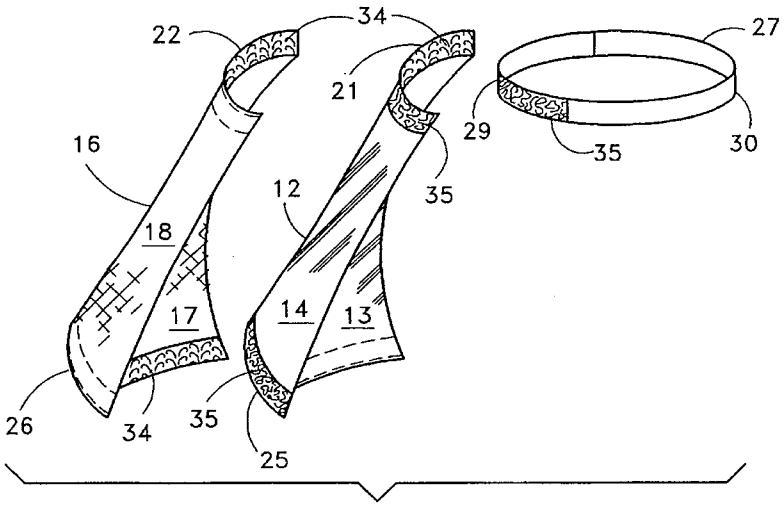
FIG. 2 is an exploded side view of the shroud with a continuous loop-type waistband.

The shroud 10 in FIG. 2 is shown completely disassembled. The waistband 27 is a continuous loop. The front portion 30 of the waistband 27 is made of a flexible or resilient material adapted to fit the user and to expand and contract such as, by example only, not by way of limitation, elastic. The back portion 29 of the waistband 27 can be made of flexible or inflexible material. In those embodiments where the back portion 29 is made of inflexible material, the length of the inflexible material can be substantially equal in length to the length of the fasteners contained thereon.

The inner layer 12 has inner surface 13 and outer surface 14; the outer layer 16 has inner surface 17 and outer surface 18. Though any type and combination of cooperating fasteners may be used and placed anywhere on the various surfaces to be joined, in this embodiment the fasteners for attaching the inner layer 12 to the waistband 27, and for attaching the top section 21 of the inner layer 12 to the top section 22 of the outer layer 16 are hook-and-loop fasteners 34 and 35 with 34 as the hook part of the hook-and-loop fastener and 35 as the loop part of the hook-and-loop fastener. This embodiment also reveals that the inner layer 12 may also be attached to the outer layer 16 at the bottom section 25 of the inner layer 12 and at the bottom section 26 of the outer layer 16 using the same type fasteners. By way of example only, not by way of limitation, the hook part 34 is positioned on the inner surface 17 of the outer layer 16 at its top section 22 and at its bottom section 26. It is also positioned on the inner surface 13 of the inner layer 12 at its top section 21. The loop part 35 is positioned on the outer surface 14 of the inner layer 12 at its top section 21 and at its bottom section 25. It is also positioned on the back portion 29 of the waistband 27. The outer surface 18 of the outer layer 16 provides the decorative patterns suited to an individual user. The inner layer 12 and the outer layer 16 can be of many geometric shapes including, but not limited to, triangular, semi-circular, semi-oblong, square, and rectangular.

Figure 3:
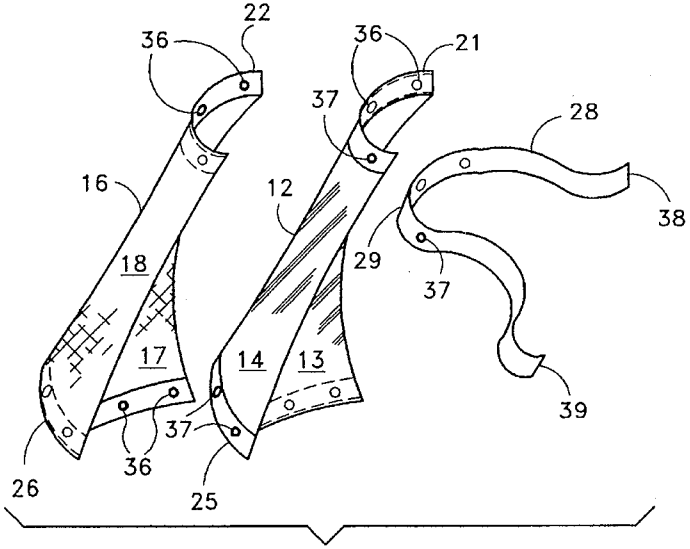
FIG. 3 is an exploded side view of the shroud with a single-strip type waistband.

FIG. 3 is another embodiment of the shroud 10 revealing a single-strip non-flexible waistband 28 having a first end 38 and and second end 39 with no fasteners. In this embodiment, the waistband 28 is of sufficient length so that it may wrap around a user and have both ends 38 and 39 substantially overlap. The ends 38 and 39 can thereafter be tied together to secure the waistband 28 to the user. In this embodiment, male-and-female snap fasteners 36 and 37 are the fasteners for attaching the inner 12 and outer 16 layers together and for attaching the shroud 10 to the back portion 29 of the waistband 28. By way of example only, and not by way of limitation, 36 is the male end of the male-and-female snap fastener and 37 is the female end of the male-and-female snap fastener. Though any combination of cooperating fasteners may be used and placed anywhere on surfaces to be joined, the male end 36 in this embodiment is positioned on the inner surface 17 of the outer layer 16 at its top section 22 and at its bottom section 26. It is also positioned on the inner surface 13 of the inner layer 12 at its top section 21. The female end 37 is positioned on the outer surface 14 of the inner layer 12 at its top section 21 and at its bottom section 25. It is also positioned on the back portion 29 of the waistband 28.

The overlapping lengths of the first end 38 and the second end 39 of the single-strip waistband 28 of FIG. 3 can also have on its overlapping adjacent surfaces cooperating hook-and-loop fasteners 34 and 35 as shown in FIG. 2, cooperating male-and-female snap fasteners 36 and 37 as shown in FIG. 3, or any type and configuration of suitable fasteners to attach both ends 38 and 39 together to secure the waistband 28 to the user. Provided the fasteners used cooperate with the parts to be joined, any combination of fasteners can be used.

Figure 4:
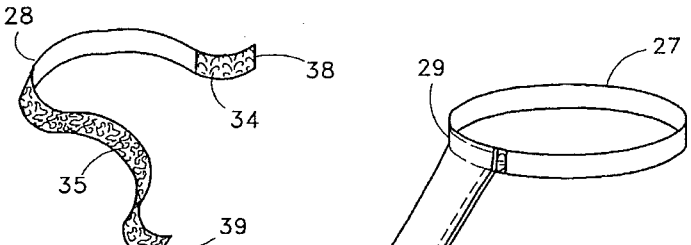
FIG. 4 is a perspective elevation view of the waistband.

As shown in FIG. 4, one complete surface of the waistband 28 also can be configured with either the hook 34 or the loop 35 part of hook-and-loop fasteners. The opposite surface of either overlapping end 38 or 39 would have the cooperating fastening part 34 or 35 of substantial length thereon and intermediate to its respective end so that that overlapping end may overlap its counterpart end and secure itself to the surface of the waistband 28 having its complete surface configured with the cooperating fastening part 34 or 35. In the embodiment shown in FIG. 4, the loop part 35 encompasses the complete surface of the waistband 28 while first end 38 contains the cooperating hook part 34. The hook part 34 is intermediate to the first end 38 and is of sufficient length such that when overlapped upon the second end 39 it secures to the loop part 35 on the waistband 28 and holds the waistband 28 to a user.

Figure 5:
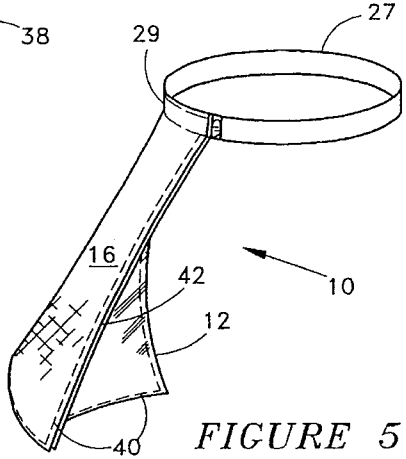
FIG. 5 is a perspective side view of the shroud showing the layers permanently connected to one another.

FIG. 5 is another embodiment of the shroud 10 wherein the inner layer 12 and the outer layer 16 are attached to one another, either permanently or removably, along all sections; top, sides, and bottom. By way of example only, not by way of limitation, the layers 12 and 16 can be permanently attached by stitches 40 or by any other fasteners 42 suited for the purpose. As in the previously described embodiments, the layers 12 and 16 are removably attached to the back portion 29 of the waistband 27 or 28. The preferred fasteners are hook-and-loop 34 and 35 or male-and-female snaps 36 and 37 as previously described and shown in FIGS. 2 and 3, though any type or combination of cooperating fastener can be used.

The invention is not limited to the embodiments described above but all changes and modifications thereto not constituting departures from the spirit and scope of the invention are intended to be included.

While the specific embodiments of the shroud has been shown and fully explained above for the purpose of illustration, it should be understood that many other uses will be found for the instant invention disclosure and many alterations, modifications, and substitutions may be made thereto without departing from the spirit and scope of the invention as defined by the appended claims. Such are intended to be included within the scope of the invention.

What is claimed is:

1. An exercise perspiration barrier for a person for preventing perspiration from the body of said person from migrating to the outer surface of said barrier comprising:

a waistband having a front and back portion for placement around the waist of said person;

at least two layers, a first inner-most layer and a second outer-most layer, said layers each further having an inner and an outer surface and a plurality of sections comprising a top section, side sections, and a bottom section, said first layer removably connected to said second layer and said first layer removably connected to said waistband, said layers extending downwardly therefrom along the backside of said person, at least one of said layers being moisture repellent; and first and second separate attachment means, said first attachment means for removably connecting said first layer to said second layer and said second attachment means for removably connecting said first layer to said waistband.

2. The invention as defined in claim 1 wherein said waistband is a continuous loop.

3. The invention as defined in claim 2 wherein said front portion of said waistband is elastic.

4. The invention as defined in claim 2 wherein said waistband is elastic.

5. The invention as defined in claim 1 wherein one of said first and second attachment means is on said back portion of said waistband and on said top section of said inner surface of said inner-most layer.

6. The invention as defined in claim 1 wherein said first and second attachment means comprise cooperating hook-and-loop fasteners.

7. The invention as defined in claim 1 wherein said first and second attachment means comprise cooperating male-and-female snap fasteners.

8. The invention as defined in claim 1 wherein said waistband further comprises a first and a second free end, a first and a second side, and a securing means for securing said first and second free ends to each other, said waistband being of substantial length such that said free ends substantially overlap when wrapped around the waist of said person for size-adjustment suitable for a given sized waist of various persons.

9. The invention as defined in claim 8 wherein said securing means comprises tying said free ends together.

10. The invention as defined in claim 8 wherein said securing means comprises cooperating hook-and-loop fasteners intermediate to said frees ends on the opposing overlapping sides of said waistband.

11. The invention as defined in claim 8 wherein said securing means comprises cooperating male-and-female fasteners intermediate to said frees ends on the opposing overlapping sides of said waistband.

12. The invention as defined in claim 8 wherein said securing means comprises one component of a hook-and-loop fastener on said first side of said waistband and the cooperating component of said hook-and-loop fastener on said second side of said waistband intermediate to said first free end.

13. The invention as defined in claim 1 further comprising a connecting means for removably inter-connecting said layers to each other.

14. The invention as defined in claim 13 wherein said layers are inter-connected along at least one said section.

15. The invention as defined in claim 13 wherein said layers are inter-connected along more than one said section.

16. The invention as defined in claim 13 wherein said connecting means comprises cooperating hook-and-loop fasteners.

17. The invention as defined in claim 13 wherein said connecting means comprises cooperating male-and-female snap fasteners.

18. The invention as defined in claim 1 wherein said inner-most layer is comprised of said moisture-repellent material.

19. The invention as defined in claim 1 wherein said layers are permanently connected to each other.

* * * * *